US009994058B2

(12) United States Patent
Hata

(10) Patent No.: US 9,994,058 B2
(45) Date of Patent: Jun. 12, 2018

(54) BOOKBINDING APPARATUS AND IMAGE FORMING SYSTEM

(75) Inventor: Kiyoshi Hata, Tokyo (JP)

(73) Assignee: KONICA MINOLTA BUSINESS TECHNOLOGIES, INC., Tokyo (JP)

( * ) Notice: Subject to any disclaimer, the term of this patent is extended or adjusted under 35 U.S.C. 154(b) by 38 days.

(21) Appl. No.: 12/810,717

(22) PCT Filed: Jun. 25, 2009

(86) PCT No.: PCT/JP2009/061590

§ 371 (c)(1),
(2), (4) Date: Jun. 25, 2010

(87) PCT Pub. No.: WO2010/016339

PCT Pub. Date: Feb. 11, 2010

(65) Prior Publication Data

US 2010/0278618 A1 Nov. 4, 2010

(30) Foreign Application Priority Data

Aug. 8, 2008 (JP) ..... 2008-205269

(51) Int. Cl.

| | |
|---|---|
| ***B42D 1/00*** | (2006.01) |
| ***B42D 5/00*** | (2006.01) |
| ***B42C 9/00*** | (2006.01) |
| ***B42B 5/08*** | (2006.01) |
| ***B42B 9/00*** | (2006.01) |

(Continued)

(52) U.S. Cl.

CPC ..... *B42C 9/0025* (2013.01); *B26F 1/12* (2013.01); *B42C 1/12* (2013.01); *B42C 5/04* (2013.01)

(58) Field of Classification Search

CPC .... B42D 1/00; B42D 5/00; B42C 9/00; B42C 1/00; B42B 5/08; B42B 9/00; B42B 5/00; B41L 43/00; B65H 33/04; B65H 39/00

USPC ..... 281/38; 412/1, 6, 7, 8, 16, 33, 37; 270/32, 45, 58.07

See application file for complete search history.

(56) References Cited

U.S. PATENT DOCUMENTS 2,679,901 A * 6/1954 Cahen ..... 412/16
4,741,236 A * 5/1988 Averill ..... B23D 45/10 412/16

(Continued)

FOREIGN PATENT DOCUMENTS

CN 1944072 A 4/2007
EP 1759870 A2 3/2007

(Continued)

OTHER PUBLICATIONS

International Search Report for PCT/JP2009/061590 dated Aug. 4, 2009 with English translation.

*Primary Examiner* — Justin V Lewis
(74) *Attorney, Agent, or Firm* — Cantor Colburn LLP

(57) ABSTRACT

The book binding device includes a section for forming a cut in the end side of a conveyed sheet, a control section for controlling the section for forming a cut, and a selection section for selecting each sheet for the presence/absence of a cut to be formed by the section for forming a cut, wherein the control section controls the formation of a cut by the section for forming a cut based on the presence/absence of the formation of a cut selected by the selection section, and then the mixture of sheets in which cuts are formed and sheets in which cuts are not formed are bundled and bound to complete a booklet.

18 Claims, 15 Drawing Sheets

(51) Int. Cl.

| | |
|---|---|
| ***B42B 5/00*** | (2006.01) |
| ***B42C 1/00*** | (2006.01) |
| ***B65H 33/04*** | (2006.01) |
| ***B65H 39/00*** | (2006.01) |
| ***B26F 1/12*** | (2006.01) |
| ***B42C 5/04*** | (2006.01) |
| ***B42C 1/12*** | (2006.01) |

(56) References Cited

U.S. PATENT DOCUMENTS

| | | | | |
|---|---|---|---|---|
| 7,490,860 | B2 * | 2/2009 | Didde | 412/6 |
| 7,854,581 | B2 * | 12/2010 | Kubo | B42C 19/02 412/29 |
| 2001/0008602 | A1 * | 7/2001 | Garrido | B42C 19/02 412/9 |
| 2001/0040371 | A1 * | 11/2001 | Dahlquist | G09F 23/10 283/51 |
| 2002/0168247 | A1 * | 11/2002 | Trovinger | B42C 1/12 412/1 |
| 2004/0141830 | A1 | 7/2004 | Yoshie et al. | |
| 2007/0045928 | A1 | 3/2007 | Yoshie et al. | |
| 2009/0035094 | A1 * | 2/2009 | Fischer | B42C 11/04 412/21 |

FOREIGN PATENT DOCUMENTS

| | | | |
|---|---|---|---|
| JP | 2000-318345 | A | 11/2000 |
| JP | 2003-127564 | A | 5/2003 |
| JP | 2004-209869 | A | 7/2004 |
| JP | 2007-062145 | A | 3/2007 |
| JP | 2008-168969 | A | 7/2008 |

* cited by examiner

BOOKBINDING APPARATUS AND IMAGE FORMING SYSTEM

CROSS REFERENCE TO RELATED APPLICATIONS

This is a U.S. national stage application of International Application No. PCT/JP2009/061590, filed on 25 Jun. 2009. Priority under 35 U.S.C. § 119(a) and 35 U.S.C. § 365(b) is claimed from Japanese Application No. JP2008-205269, filed 8 Aug. 2008, the disclosure of which is also incorporated herein by reference.

TECHNICAL FIELD

The present invention relates to a bookbinding apparatus in which an adhesive is coated on the spine portion of a sheet bundle containing a plurality of sheets and a booklet is produced by allowing a coversheet to bond to the spine portion of the sheet bundle; and an image forming system having the bookbinding apparatus.

BACKGROUND

Recent image forming apparatuses of an electrophotographic system feature high-speed performance, multi-functions, and network functions and are expanding their applications as printing apparatuses via connection with a large-capacity paper feed apparatus and a large-capacity stacker. When an image forming apparatus is used as a printing apparatus, only a single apparatus can carry out operations from printing to bookbinding by connecting a bookbinding apparatus thereto to bookbind printed matter.

As the above bookbinding apparatus, disclosed is a smaller-sized, glue applying bookbinding apparatus in which a sheet bundle storing section, a glue (adhesive) coating section, a coversheet feed section, and a coversheet folding section are tandemly arranged in the vertical direction (for example, refer to Patent Document 1).

The glue applying bookbinding apparatus disclosed in Patent Document 1 uniformly coats an adhesive, using an adhesive coating roller, on the spine portion of a sheet bundle stored and nipped in the sheet bundle storing section. The adhesive is coated only on the spine portion of the sheet bundle, whereby the adhesion area is small, resulting in inadequate strength in glue applying bookbinding. Therefore, when the thus-produced booklet is opened, some sheets may be dropped off due to peeling of adhered portions.

In contrast, in a bookbinding apparatus carrying out case bookbinding operations in which the spine portion of a sheet bundle is bonded with a coversheet, a bookbinding apparatus is disclosed in which in a sheet conveyance path of the bookbinding apparatus, a notch forming section is provided to form notches on the edge side coated with an adhesive during sheet bookbinding processing (for example, refer to Patent Document 2).

PRIOR ART DOCUMENTS

Patent Documents

Patent Document 1: Unexamined Japanese Patent Application Publication (hereinafter referred to as JP-A) No. 2004-209869

Patent Document 2: JP-A No. 2007-62145

SUMMARY OF THE INVENTION

Problems to be Solved by the Invention

In Patent Document 2, notches are formed per sheet in a notch forming section to enhance the strength of a booklet after bookbinding. When all sheets to be used are plain paper sheets, each page (each sheet) of a bookbound booklet can be allowed to exhibit the almost same tensile strength.

However, the booklet is not entirely constituted of plain paper. For example, bookbinding is carried out in some cases by inserting sheets made of coated paper having large weighing amount as insert sheets between plain paper sheets. Sheets having large weighing amount (hereinafter referred to as coated paper) such as the above coated paper are usually thicker and stiffer than the plain paper sheets. Thereby, in the case of the same tensile strength as in the plain paper sheets, when a produced booklet is opened, some coated paper sheets may be dropped off due to peeling of adhered portions.

In view of the above circumstances, the present invention was completed, and an object thereof is to provide a bookbinding apparatus to produce a booklet in which even in cases where a booklet is produced by bookbinding a sheet bundle containing mixed sheets differing in paper type such as plain paper and coated paper, when the booklet is opened, no coated paper sheets are dropped off due to peeling of adhered portions.

Means to Solve the Problems

The above object can be achieved by the following constitution:

1. In a bookbinding apparatus wherein an adhesive is coated on a spine portion of a sheet bundle constituted of a plurality of sheets and a booklet is produced by allowing a coversheet to bond to the spine portion of the sheet bundle, a bookbinding apparatus having a notch forming section to form notches in an edge portion of a conveyed sheet; a selecting section to select per sheet whether or not to form notches by the notch forming section; and a control section to control notch formation in the notch forming section based on information with or without notch formation selected by the selecting section and to control the notch forming section so as to form the sheet bundle containing a mixture of sheets with the notches formed and sheets without the notches formed.

2. The bookbinding apparatus, described in item 1, wherein a position moving section is provided to move a relative position of sheets forming the sheet bundle and the notch forming section in the sheet width direction at right angles to the sheet conveyance direction and the notch position of the notches can be changed per sheet or per a plurality of sheets with respect to the sheets forming the sheet bundle.

3. The bookbinding apparatus, described in item 1, wherein the selecting section can select pages in which the notches are not formed.

4. The bookbinding apparatus, described in item 1, wherein when a plurality of paper types are used for the sheets, the selecting section can select paper types in which the notches are not formed.

5. The binding apparatus, described in item 1, wherein the control section controls the notch forming section so as not to form the notches in coated paper.

6. The book binding apparatus, described in item 1, wherein the control section controls the notch forming section so as not to form the notches in a sheet processed by Z-folding.

7. The bookbinding apparatus, described in item 1, wherein the control section controls the notch forming section so as not to successively form 3 sheets or more without the notches formed.

8. The bookbinding apparatus, described in item 1, wherein the control section controls the notch forming section so as to form the notches in sheets of at least a predetermined number of pages conveyed before and after the sheets without the notches formed.

9. An image forming system having an image forming apparatus to form an image on a sheet and a bookbinding apparatus, described in any of items 1-8, which receives a sheet on which an image has been formed by the image forming apparatus to produce a booklet.

Effects of the Invention

According to the above constitution, the tensile strength of a specific sheet such as coated paper can be increased during bookbinding, and sheets can be prevented from being dropped off due to peeling of adhered portions.

PREFERRED EMBODIMENT OF THE INVENTION

An embodiment of a bookbinding apparatus according to the present invention and an image forming system provided with the bookbinding apparatus will now be described with reference to drawings that by no means limit the scope of the present invention.

Figure 1:
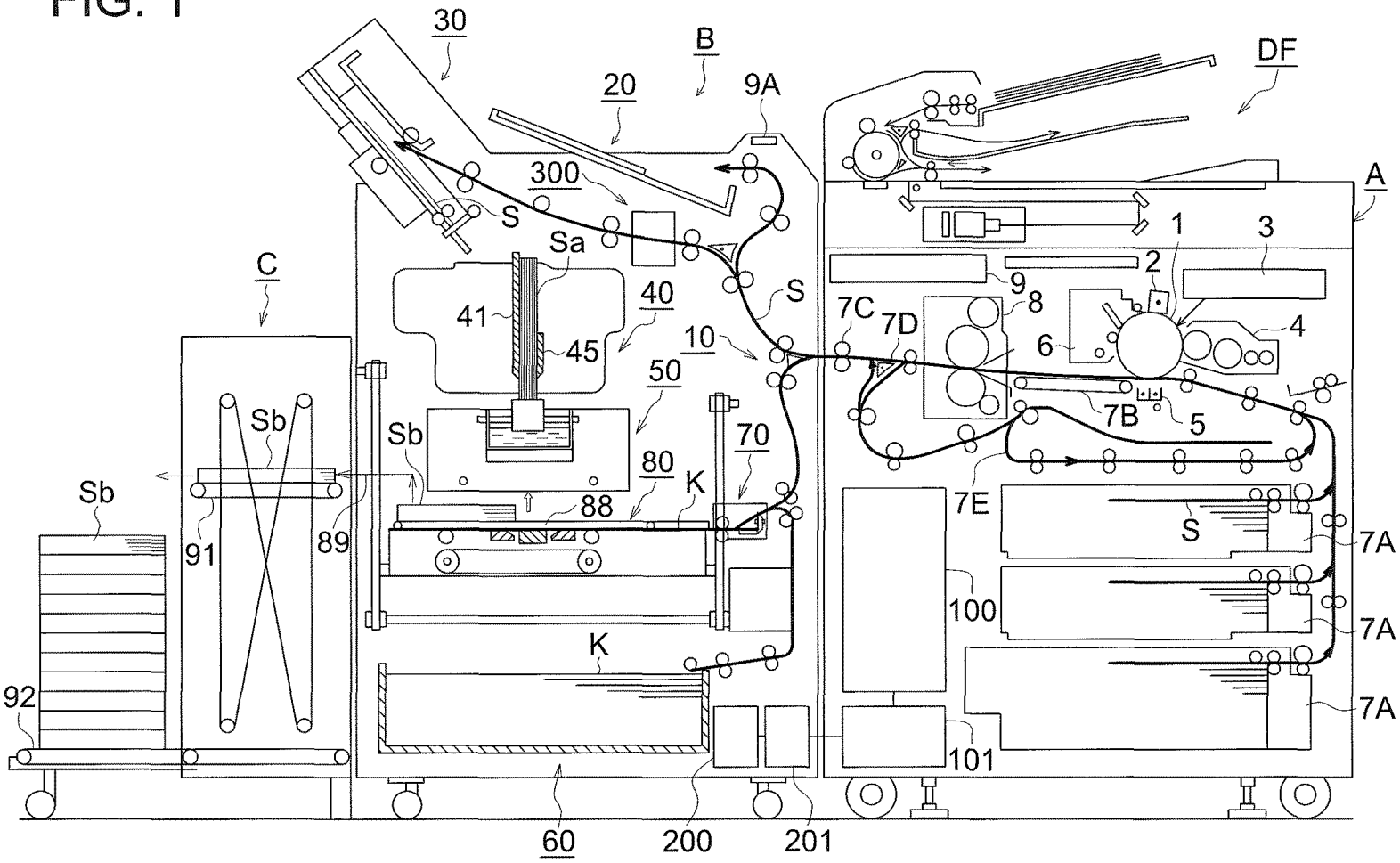
FIG. 1 is the entire constitutional view of an image forming apparatus provided with an image forming apparatus main body, a bookbinding apparatus, and a booklet storing apparatus.

FIG. 1 is the entire constitutional view of an image forming system provided with an image forming apparatus A, a bookbinding apparatus B, a booklet storing apparatus C, and an automatic document feeder DF.

[Image Forming Apparatus A]

The image forming apparatus A has an image forming section in which, in the periphery of a rotating image carrier 1, a charging section 2, an image exposure section 3, a development section 4, a transfer discharging section 5, and a cleaning section 6 are arranged.

The image forming section uniformly charges the surface of the image carrier 1 by the charging section 2, and then a latent image is formed via exposure scanning based on image data read from an original document with laser beams of the image exposure section 3. The latent image is reversely developed by the development section 4 to form a toner image on the surface of the image carrier 1.

A sheet S fed from a sheet storing section 7A is sent to a transfer position. In this transfer position, the toner image is transferred onto the sheet S by the transfer discharging section 5. Then, the charge on the surface of the sheet S is discharged to be separated from the image carrier 1. The sheet S is transferred by a transfer section 7B and subsequently heat-fixed by a fixing section 8 to be discharged from paper discharging rollers 7C.

When image formation is carried out on both sides of a sheet S, the sheet S having been heat-fixed by the fixing section 8 is diverged from a paper discharge path by a conveyance path changeover section 7D and turned over upside down by switching back in a reverse conveyance section 7E. Thereafter, the sheet S is conveyed again to the image forming section and an image is formed on the rear surface of the sheet S, followed by being passed through the fixing section 8 to be discharged from the paper discharging rollers 7C to the outside of the apparatus. The sheet S having been discharged from the paper discharging rollers 7C is sent into a bookbinding apparatus B.

With regard to the surface of the image carrier 1 after image formation, the residual toner on the surface is eliminated by the cleaning section 6 for the next image formation.

In the upper portion of the image forming apparatus A, an operation section 9 provided with an input section and a display section is arranged.

[Bookbinding Apparatus B]

As shown in FIG. 1, a bookbinding apparatus B according to the present invention is a case bookbinding apparatus having a conveyance path 10, a paper discharging section 20, a reversing section 30, a sheet bundle storing section 40, an adhesive coating section 50, a coversheet feed section 60, a cutting section 70, a booklet forming section 80, and a notch forming section 300.

Herein, the bookbinding apparatus B of the present invention is applicable to a side-stitching bookbinding apparatus, a center-folding/center-stitching bookbinding apparatus, and a sealing bookbinding apparatus, other than such a case bookbinding apparatus.

Figure 2:
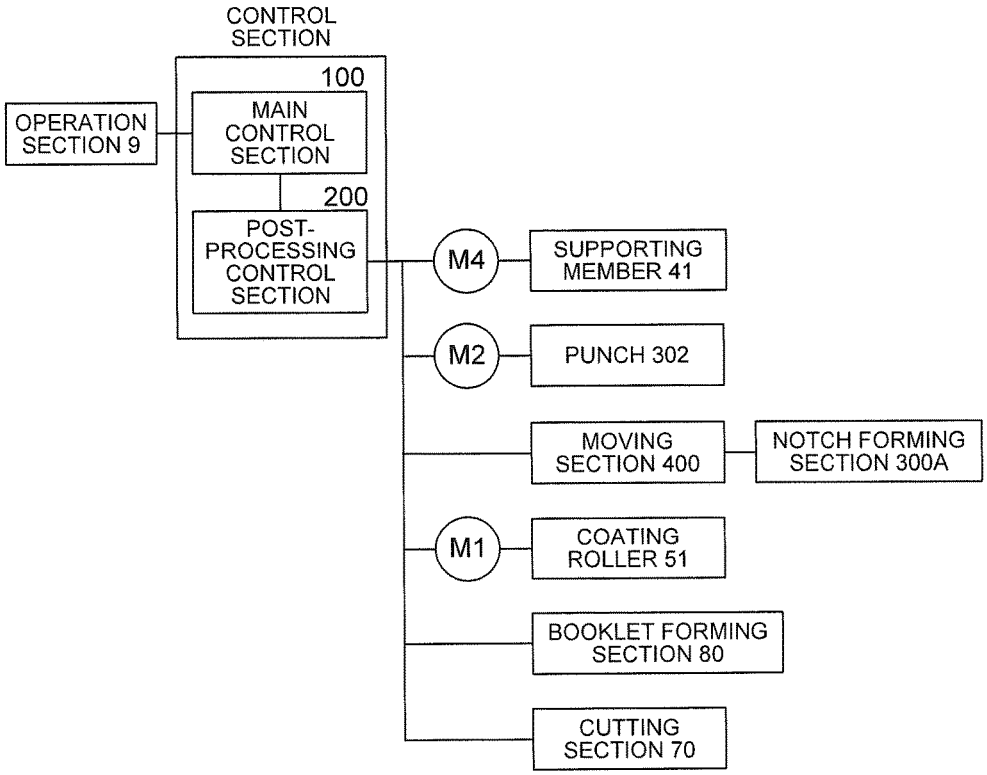
FIG. 2 is a block diagram showing the control of the present invention.

FIG. 2 is a block diagram showing the control of the present invention.

The control section of the present invention incorporates a main control section 100 provided for the image forming apparatus A and a post-processing control section 200 which is a control section to control booklet production provided for the bookbinding apparatus B, which are connected together by serial communication sections 101 and 201. In response of instructions of the main control section 100, each section of the bookbinding apparatus B is controlled in the post-processing control section 200. In the post-processing control section 200, in order to produce a booklet, the drive of each section, to be described later, is controlled.

Namely, the post-processing control section 200 controls the drive of a motor M4 to drive a supporting member 41 supporting a sheet bundle, a motor M2 to drive a punch 302 of a notch forming section 300A, a moving section 400 being a position moving section to move the relative position of a sheet S and the notch forming section 300A, and a motor M1 to drive a coating roller 51, as well as controlling the drive of the booklet forming section 80 and the cutting section 70.

Figure 3:
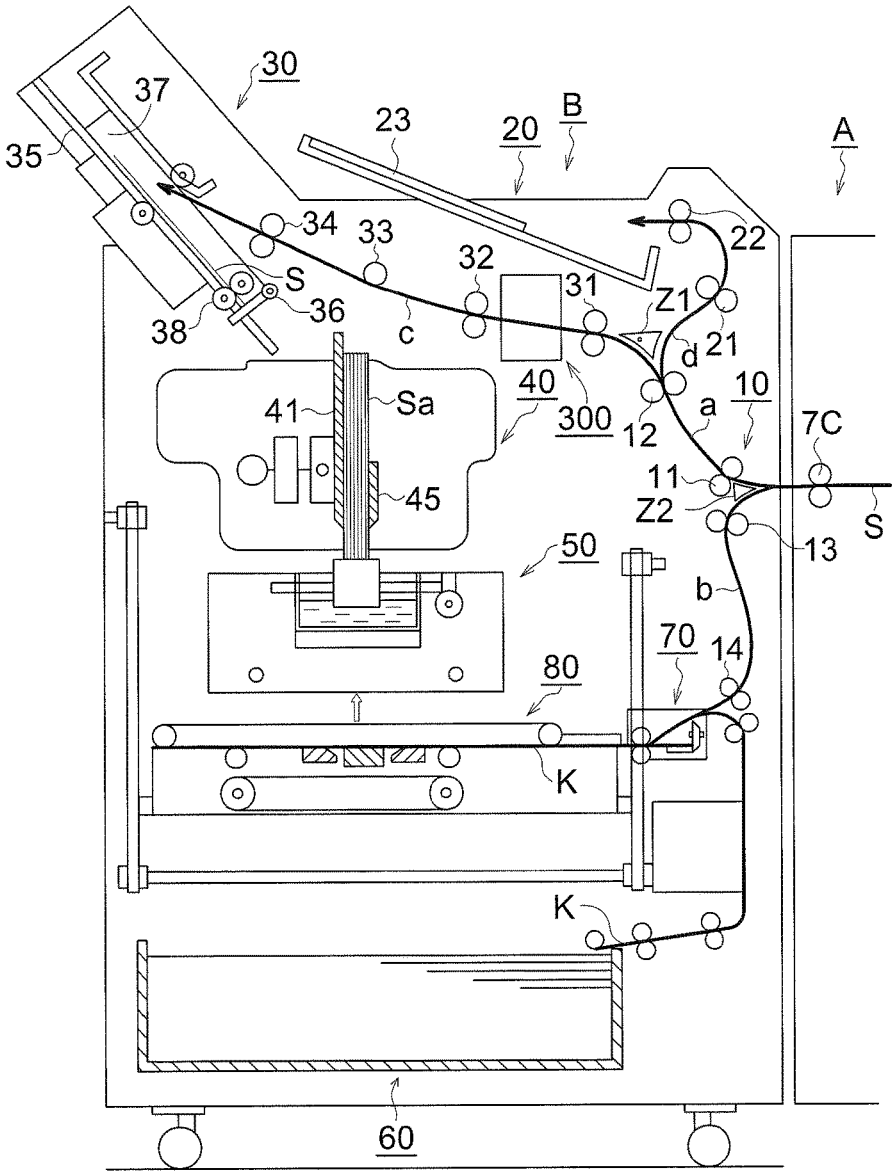
FIG. 3 is a cross-sectional view of a bookbinding apparatus according to the present invention.

FIG. 3 is a cross-sectional view of a bookbinding apparatus B according to the present invention.

<Conveyance Path 10>

A sheet S having been introduced into a conveyance path a of the conveyance path 10 of the bookbinding apparatus is conveyed by being nipped by conveyance rollers 11 and 12 to be diverged to either of the paper discharging section 20 or the reversing section 30 by a conveyance path changeover section Z1.

A conveyance path changeover section Z2 arranged on the upstream side of the sheet conveyance direction of the conveyance rollers 11 diverges the sheet S discharged from the image forming apparatus A to either of a conveyance path a or a conveyance path b. The sheet S conveyed to the conveyance path b is sent into the booklet forming section 80 by being nipped by conveyance rollers 14.

<Paper Discharging Section 20>

When paper discharging to the paper discharging section 20 is set, the conveyance path changeover section Z1 shuts off a conveyance path c leading to the sheet bundle storing section 40 and then opens a conveyance path d leading to the paper discharging section 20.

The sheet S passing through the conveyance path d leading to the paper discharging section 20 is conveyed upward by being nipped by conveyance rollers 21 and discharged by paper discharging rollers 22 onto a fixed paper discharging tray 23 located at the top of the apparatus for storage. In the present embodiment, the fixed paper discharging tray 23 directly receives the sheet S having been discharged from the image forming apparatus A with a stacking capability of up to about 300 sheets.

<Notch Forming Apparatus 300>

The sheet S having been diverged to the conveyance path c by the conveyance path changeover section Z1 is conveyed to the notch forming apparatus 300 by being nipped by conveyance rollers 31 and 32. The notch forming apparatus 300 is arranged between the conveyance rollers 31 and the conveyance rollers 32.

The notch forming apparatus 300 incorporates the notch forming section 300A, the moving section 400 (refer to FIG. 11) which is a position moving section to move the relative position of a sheet S and notches in the sheet width direction at right angles to the sheet conveyance direction, and a waste storing box 303 to store notched sheet waste.

Figure 10:
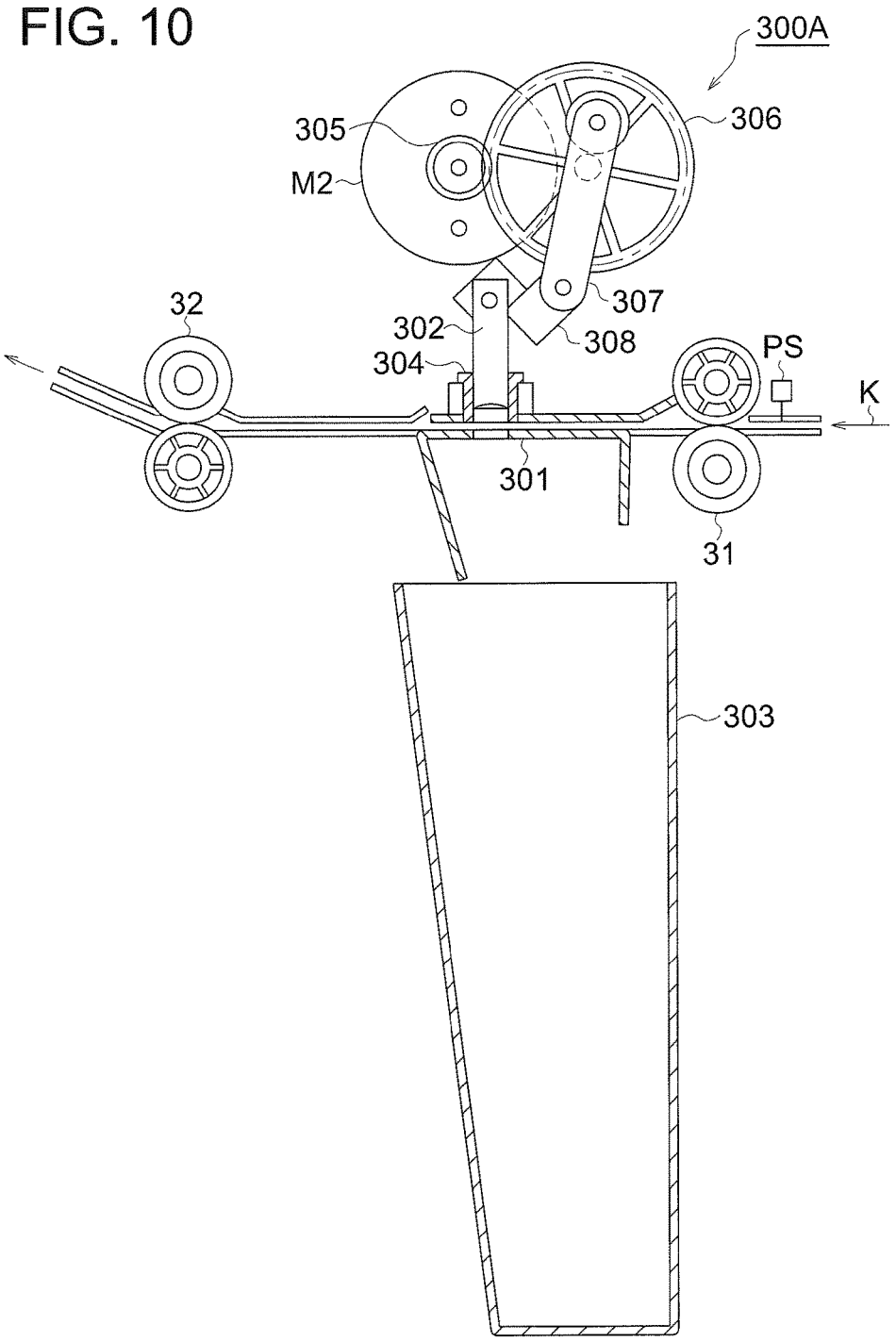
FIG. 10 is a cross-sectional view of a notch forming section.

FIG. 10 is a cross-sectional view of the notch forming section 300A.

The notch forming section 300A incorporates a die 301 placed in the sheet conveyance path, a punch 302 fitted with the die 301 via upward and downward movement, and a drive section to move the punch 302 up and down.

The outer circumferential surface of the punch 302 facing the die 301 is fitted with the interior surface of a guide member 304 so as to be movable up and down. The drive section to move the punch 302 up and down is provided with drive transmission members such as a motor M2, a small gear 305 connected to the motor M2, a large gear 306 engaged with the small gear 305, a swingingly rotatable crank 307 which is latched to one end of the large gear 306, and a connecting member 308 to connect the crank 307 to the upper portion of the punch 302.

With the drive of the motor M2, the punch 302 is driven up and down via the small gear 305, the large gear 306, and the crank 307, the connecting member 308.

Via the descending drive of the punch 302 and fitting with the die 301, notches are formed in the rear end portion of the sheet S. Herein, the drive to move the punch 302 up and down is not limited to the above mechanism, and any appropriate well-known reciprocation mechanism can be employed.

Figure 11:
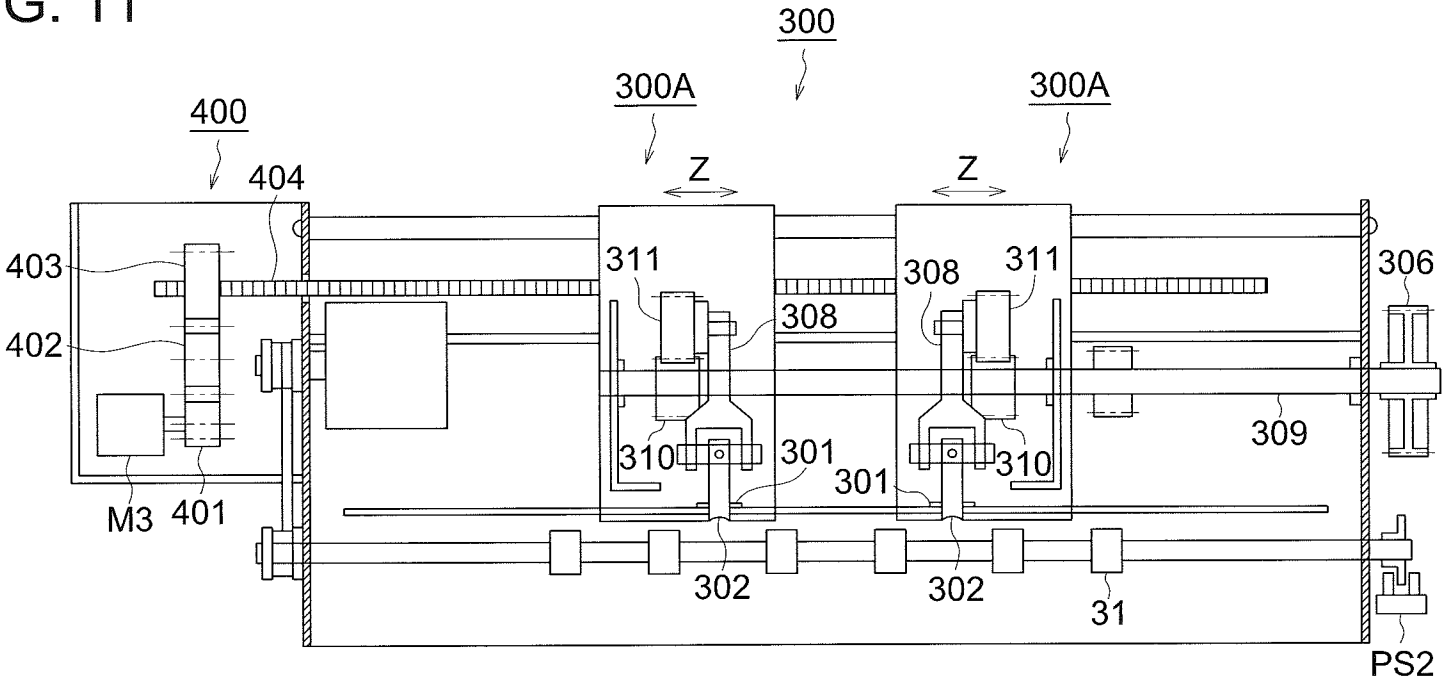
FIG. 11 is a front elevational view of a moving section.

FIG. 11 is a front elevational view showing the moving section 400 to move the relative position of a sheet S and notches in the sheet width direction at right angels to the sheet conveyance direction. In the example shown in FIG. 11, the moving section 400 moves the relative position of the sheet S and notches in such a manner that the notch forming section 300A is moved from the rear side of the bookbinding apparatus B to the front side, and in the reverse direction thereof.

When a motor M3 of the moving section 400 is driven, a feed screw 404 is rotated via a gear train containing gears 401, 402, and 403. The feed screw 404 is engaged with an engagement member (not shown) provided for the notch forming section 300A, which is moved to the arrow Z direction with the rotation of the feed screw 404. With regard to the feed screw 404 and the above engagement members, for example, a well-known linear movement mechanism such as a ball screw can be used. Further, another well-known linear movement mechanism employing a rack and pinion or a wire is also usable.

FIG. 11 is an example in which 2 pairs of the notch forming sections 300A each having a punch 302 and a die 301 are provided. Herein, the number of pairs of the notch forming sections 300A is not limited thereto. Further, the example shown in FIG. 11 shows a constitution in which one pair of the punch 302 and the die 301 forms one notch. However, another constitution is also employable in which one pair of the punch 302 and the die 301 is formed with a plurality of notch blades and then using such one pair of the punch 302 and the die 301, a plurality of notches are formed.

The sheet S having been discharged from the image forming apparatus A is passed through the notch forming section 300A with being subjected to no processing when no notch processing is set in the operation section 9 of the image forming apparatus A, for example, when no booklet discharged to and stacked in the paper discharging section 20 is produced.

Further, the operation section 9 functions, as a selecting section, to select whether or not to form notches per page in the notch forming section 300A. In cases in which notch processing is set, for example, even when a booklet is produced, pages in which no notches are formed can be selected. Instructions selected in the operation section 9 are transmitted to the post-processing control section 200 via the main control section 100. The post-processing control section 200 controls the notch forming section 300A.

In the operation section 9, when notch processing is set to form notches, the front end portion of the sheet S having been introduced into the bookbinding apparatus B is passed through the conveyance rollers 31, the notch forming position of the notch forming section 300A, and the conveyance rollers 32 to stop at a predetermined position. Namely, the rear end portion of the sheet S conveyed by being nipped by the conveyance rollers 31 and the conveyance rollers 32 is detected by a sensor PS arranged on the upstream side of the conveyance rollers 31. Thereafter, predetermined pulses are counted, for example, using a pulse counter PS2 to stop the drive of an unshown sheet conveyance motor for stopping the advancement of the sheet S. At this sheet stop position, notches Va are formed in the edge of the rear end portion of the sheet S. Formation of such notches Va can be carried out for each sheet or for plural sheets at the same time with respect to the sheet S.

Figure 12:
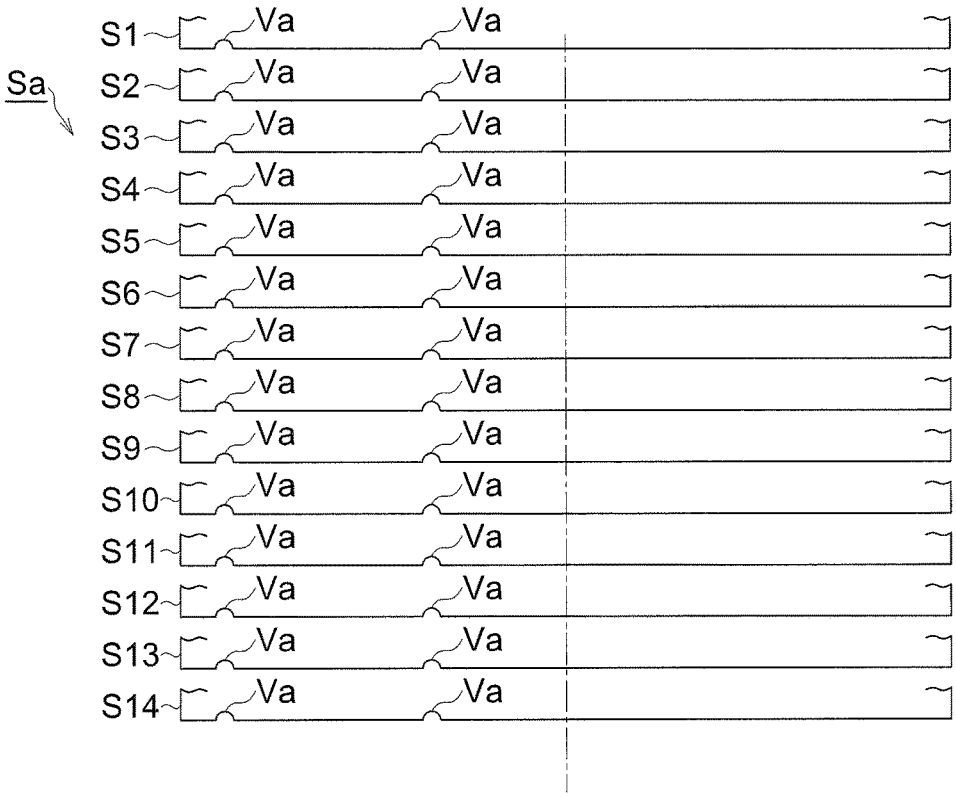
FIG. 12 is a plan view of a sheet bundle of a plurality of sheets with notches formed in the same position.
Figure 13A:
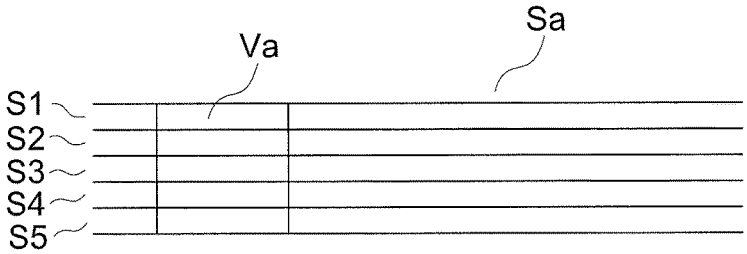
FIGS. 13*a* and 13*b* are a partial view of a groove formed by the notches Va shown in FIG. 12.
Figure 13B:
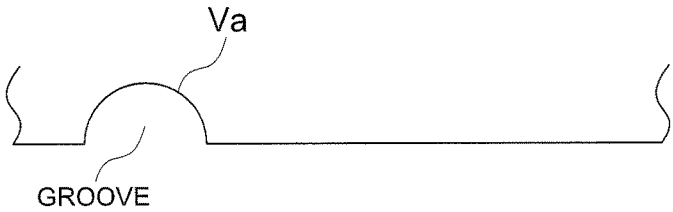

FIG. 12 is a plan view showing an example of a sheet bundle Sa of a plurality of stacked sheets S (S1-S14) with notches formed in the same position. FIG. 13 is a partial view of a groove formed by the notches Va shown in FIG. 12. FIG. 13A is a view showing viewing from the rear portion of the sheet bundle Sa and FIG. 13B is a view showing viewing from the surface of the sheet bundle Sa. The notches Va of each sheet S is overlapped and a formed groove is formed in the direction at right angles to the sheet bundle Sa.

In formation of notches Va, the notch forming section 300A is moved to a predetermined position on the left side shown by the moving section 400 and then 2 notches Va are formed in a first sheet S1 by 2 pairs of the notch forming sections 300A each having the punch 302 and the die 301. In this manner, notches Va are formed successively in sheets S1-S14. As the shape of such a notch Va, a shown semicircular, a V-shaped, or a U-shaped form is employed.

In the example shown in FIG. 12, in the step to coat an adhesive (glue) on the rear portion of a sheet bundle Sa, to be described later, the adhesive is gathered in the above groove. Such gathering of the adhesive results in traces of the adhesive in the rear portion when a booklet is produced, whereby a poor appearance thereof often results.

To decrease such traces of the adhesive, a groove formed by notches Va is preferably formed in the inclined direction with respect to the sheet bundle Sa for prevention of the gathering of the adhesive.

Figure 14:
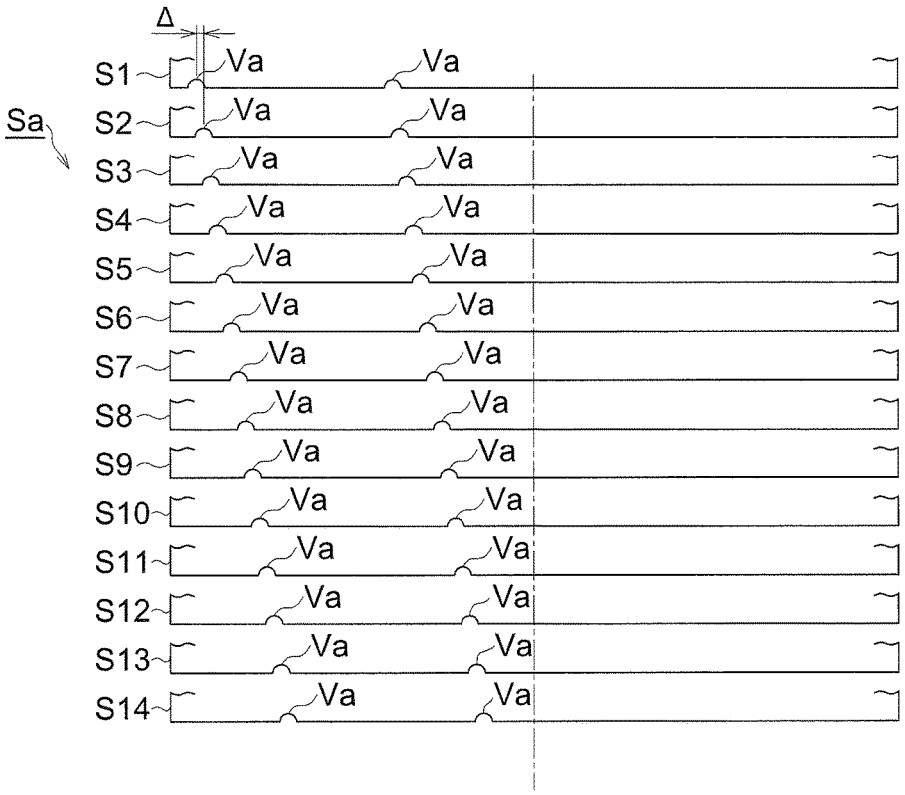
FIG. 14 is a view of a layered sheet bundle formed by shifting notches with respect to each sheet.

FIG. 14 is a plan view showing an example of a sheet bundle Sa in which notches Va are formed so as to be moved (hereinafter also referred to as "shifted") for each sheet, and a plurality of sheets S (S1-S14) are stacked so that a groove formed by the notches Va is formed in the inclined direction with respect to the sheet bundle Sa.

Figure 15A:
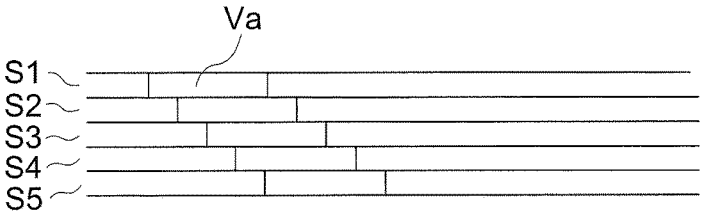
FIGS. 15*a* and 15*b* are a partial view of a groove formed by the notches Va shown in FIG. 14.
Figure 15B:
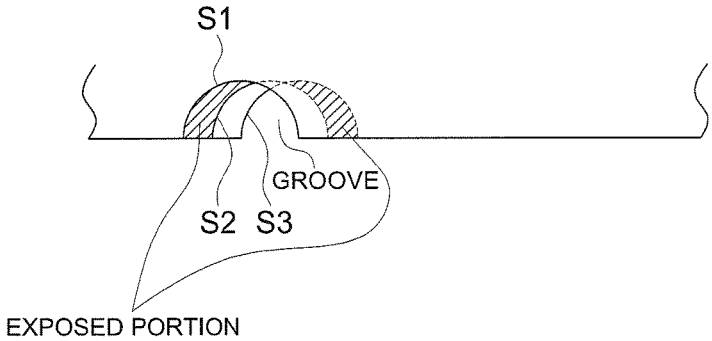

FIG. 15 is a partial view of a groove formed by the notches Va shown in FIG. 14. FIG. 15A is a view showing viewing from the rear portion of the sheet bundle Sa and FIG. 15B is a view in which the notches Va of sheets S1-S3 is viewed from the surface of the sheet bundle Sa.

In formation of the notches Va shown in FIG. 14, the notch forming section 300A is moved to a predetermined position on the left side shown by the moving section 400 and then 2 notches Va are formed in a first sheet S1 by 2 pairs of the notch forming sections 300A each having the punch 302 and the die 301.

Subsequently, the notch forming section 300A is moved by the moving section 400 by a predetermined distance (hereinafter also referred to as a moving distance) Δ and then 2 notches Va are made in a second sheet S2 by 2 pairs of the punching sections of the notch forming section 300A. In this example, the predetermined distance Δ is set in such an arrangement that a part of each hole diameter is overlapped.

Then, in the same manner, made are notches Va each having a predetermined shifted distance Δ of the punching position with respect to a plurality of sheets S (S3-S14). The predetermined distance Δ is appropriately set based on bookbinding test production and specifications such as conventional bookbinding conditions, depending on the sheet type, the number of sheets, and the booklet thickness. Further, shifting of the notches Va can be carried out not only for each sheet but also for a plurality of sheets.

As shown in FIG. 14, the notches Va are shifted for each sheet, whereby a groove formed by the notches Va is formed in the inclined direction with respect to the sheet bundle Sa, resulting in prevention of gathering of an adhesive.

Further, as shown by the oblique line portions of FIG. 15B, exposed portions being not overlapped with an adjacent sheet are formed in a part of the sheet surface in the vicinity of the notches Va and then an adhesive is allowed to adhere thereto. Thereby, the adhesion strength of the sheet bundle Sa can be enhanced, compared to the example shown in FIG. 12.

Herein, as described above, 2 notches Va are formed on the left side shown in the sheet S1 and then the notch forming section 300A is moved to the right side shown to form 2 notches Va (not shown) in a predetermined position on the right side shown, whereby 4 notches Va can be formed. Incidentally, the number of notches Va, the formed position, and the forming order are not limited thereto.

Further, as another embodiment of the position moving section to move the relative position of a sheet S and notches, there may be provided, in FIG. 10, a shift conveyance section 32A (not shown) having a drive section to shift the conveyance rollers 32 located on the downstream side of the sheet conveyance direction of the notch forming section 300A in the sheet width direction at right angles to the sheet conveyance direction. In this case, the shift conveyance section 32A shifts the supported sheet S, together with the conveyance rollers 32, by a predetermined distance Δ in the sheet width direction at right angles to the sheet conveyance direction.

Figure 16:
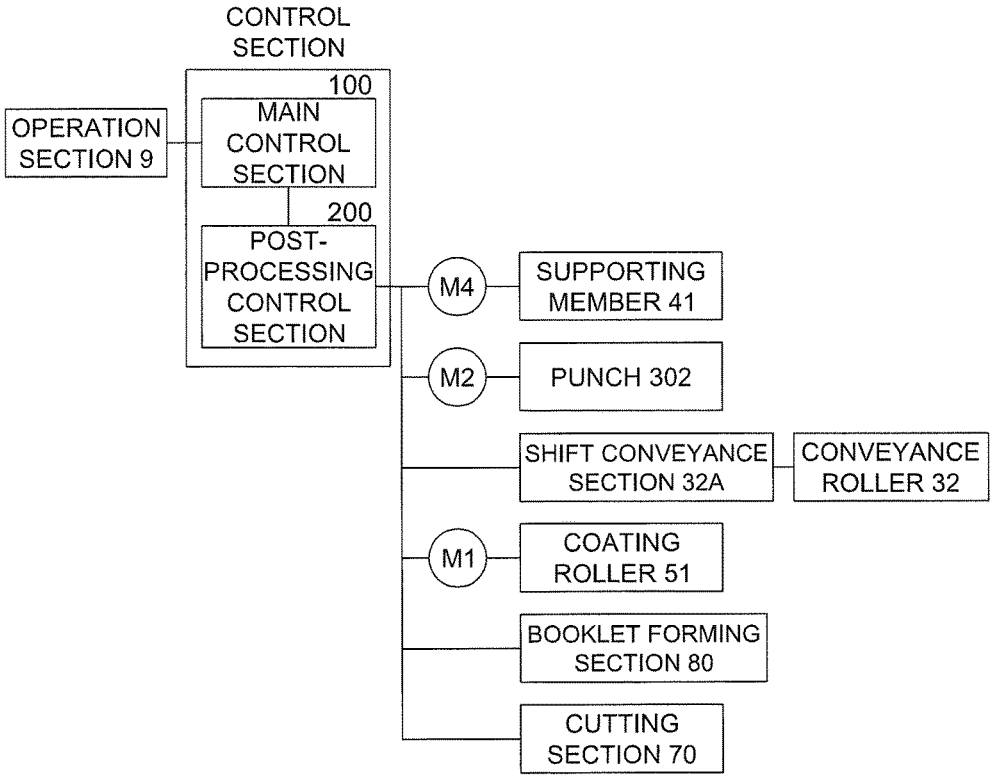
FIG. 16 is a block diagram showing the control of another embodiment with respect to notch shifting.

FIG. 16 a block diagram showing the control in an example of the embodiments in which a shift conveyance section 32A is provided.

In this embodiment, instead of the moving section 400 of FIG. 2, a shift conveyance section 32A is provided to shift the conveyance rollers 32 in the sheet width direction and a control section is provided to control the shift conveyance section 32A in the post-processing control section 200.

Notches Va are formed in a first sheer S1 by the notch forming section 300A, followed by being conveyed. Then, a second sheet S2 is conveyed and the sheet S2 supported together with the conveyance rollers 32 is shifted by a predetermined distance Δ in the direction at right angles to the sheet conveyance direction by the shift conveyance section 32A. Thereby, 2 notches Va are formed in the second sheet S2 by the notch forming section 300A.

Still further, as another embodiment, in FIG. 10, a regulation member (not shown) conforming to the sheet width direction is arranged in the vicinity of the notch forming section 300A. And, in the state where sheet nipping by the conveyance rollers 32 is released, the sheet S is shifted by a predetermined distance Δ in the sheet width direction by the regulation member. Thereby, 2 notches Va can also be formed in the second sheet S2 by the notch forming section 300A.

In the example shown in FIG. 14 as described above, when sheets S are layered to form a sheet bundle Sa, notches Va are arranged into an oblique groove in the rear portion of the sheet bundle Sa.

Figure 17:
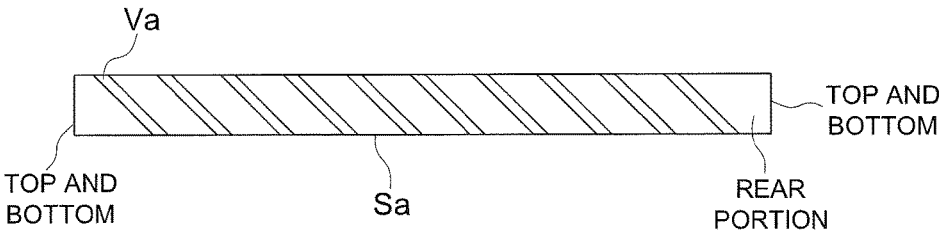
FIG. 17 is an example in which notches are shifted in one direction.
Figure 18:
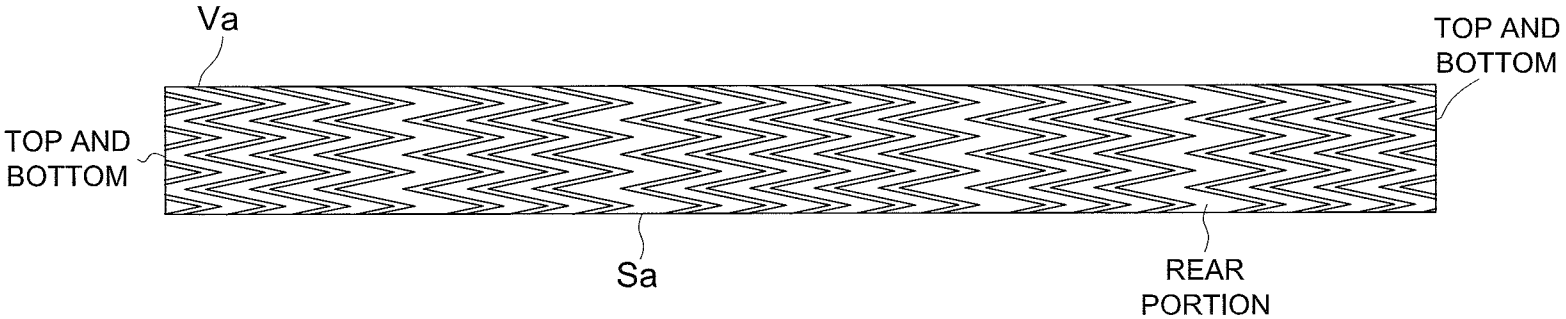
FIG. 18 is an example in which notches are shifted in the right and left directions in a shuttle manner.

In the example shown in FIG. 14, notches Va are formed with shifting to one direction (the right direction shown). However, notches Va are formed in a predetermined number of sheets with shifting to one direction and thereafter, notches Va can also be formed in successive sheets S with shifting to the reverse direction (the left direction shown) via shuttling. FIG. 17 and FIG. 18 are views showing examples, in which in FIG. 17, notches Va are formed in a sheet S with shifting to one direction (the right direction shown) and in FIG. 18, notches Va are formed in a sheet S with shuttle shifting in the right and left directions shown to produce a sheet bundle Sa.

In this case, when sheets to be used are ones such as plain paper sheets, as shown in FIG. 12 or FIG. 14, each page (each sheet) of a booklet bookbound via formation of notches Va can be allowed to exhibit the almost same tensile strength.

However, as described above, in some cases, bookbinding is carried out, for example, in such a manner that a sheet made of coated paper having large weighing amount is inserted between pain paper sheets as an insert sheet. A sheet having large weighing amount such as the coated paper (hereinafter referred to as coated paper) is usually thicker and stiffer than the plain paper. Therefore, with the same tensile strength as in the plain paper, when a produced booklet is opened, coated paper sheets are often dropped off due to peeling of adhered portions. To respond thereto, the tensile strength of a specific sheet such as coated paper needs to be increased.

In the bookbinding apparatus B of the present invention, no notches Va are formed in the above specific sheet inserted between sheets with formed notches Va, and thereby the area to which an adhesive is allowed to adhere in the specific sheet is increased and then the tensile strength thereof is increased.

Figure 19A:
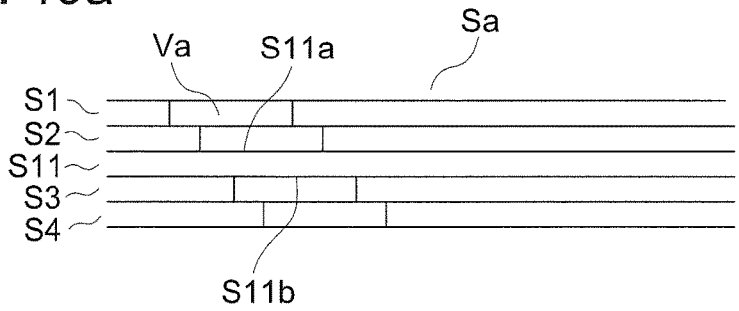
FIGS. 19*a* and 19*b* are a schematic view showing a configuration in which the tensile strength of a specific sheet is increased.
Figure 19B:
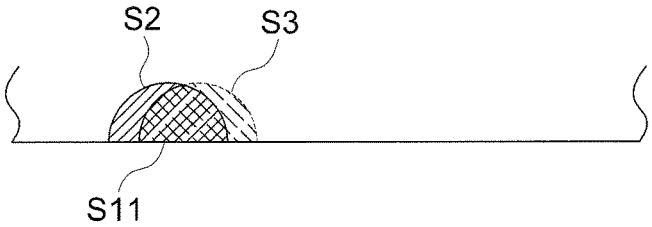

FIG. 19 is a schematic view showing a configuration in which the tensile strength is increased. FIG. 19 A is a view showing viewing from the rear portion and FIG. 19B is a view showing viewing from the surface. The sheets S1-S4 are, for example, plain paper sheets formed with notches Va. The sheet S11 is, for example, a coated paper sheet which needs to exhibit an increased tensile strength and then no notches Va are formed therein.

No notches Va are formed in the sheet S11. Thereby, when an adhesive is coated on the rear portion of a sheet bundle Sa, the adhesive is allowed to adhere to an area S11*a* surrounded by the notch Va of the sheet S2 and to an area S11*b* surrounded by the notch Va of the sheet S3. In such a manner, the area to which the adhesive is allowed to adhere is increased in the sheet S11, whereby the tensile strength of the sheet S11 is enhanced. Thereby, the tensile strength of a specific sheet can be increased during bookbinding, whereby sheets can be prevented from being dropped off due to peeling of adhered portions.

Selection of a sheet with no notches Va formed can be carried out via selection of a corresponding page by the operation section 9. The page selection is not limited to a specific paper type such as coated paper, and plain paper may be designated if appropriate. For example, there are cases in which the tensile strength of plain paper to be Z-folded is allowed to increase. Instructions having been selected in the operation section 9 are transmitted to the post-processing control section 200 via the main control section 100, and then the notch forming section 300A is controlled by the post-processing control section 200.

Such selection of a sheet with no notches formed may be carried out in such a manner that data previously making the connection between a paper type and a page of the paper type is provided for the main control section 100 or the post-processing control section 200, and thereby the paper type is selected in the operation section 9.

Figure 20A:
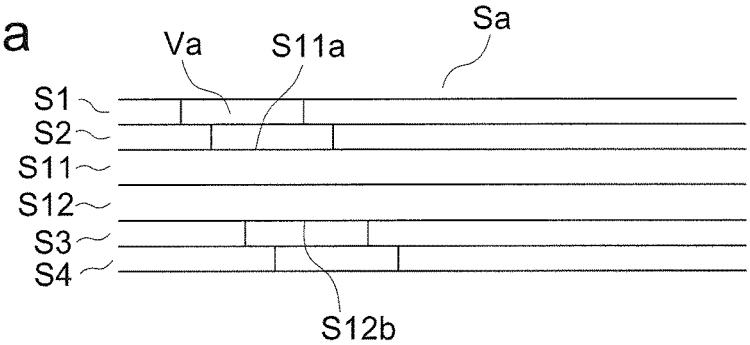
FIGS. 20*a* and 20B are an example in which pages of a specific sheet with no notches formed are continued.

Herein, when sheets S with no notches Va formed are continued, the sheets S are preferably allowed to exist at the second page or backward so as not to decrease tensile strength. FIG. 20 is a view showing an example in which the sheets S with no notches Va formed are continued. FIG. 20A is a case in which 2 pages of a sheet S11 and a sheet S12 are exemplified, and FIG. 20B is a case in which 3 pages of a sheet S11, a sheet S12, and a sheet S13 are exemplified.

In FIG. 20A, the sides of the sheets S11 and S12 with no notches Va formed to which an adhesive is applied are the surface S11*a* surrounded by a notch Va of the sheet S2 in the sheet S11 and the surface S12*b* surrounded by a notch Va of the sheet S3 in the sheet 12, respectively. Compared to the case of FIG. 19, the surface to which the adhesive is applied is present only on one side each in the sheets S11 and S12. However, tensile strength can be enhanced compared to the case in which notches Va are formed in the sheets S11 and S12.

Figure 20B:
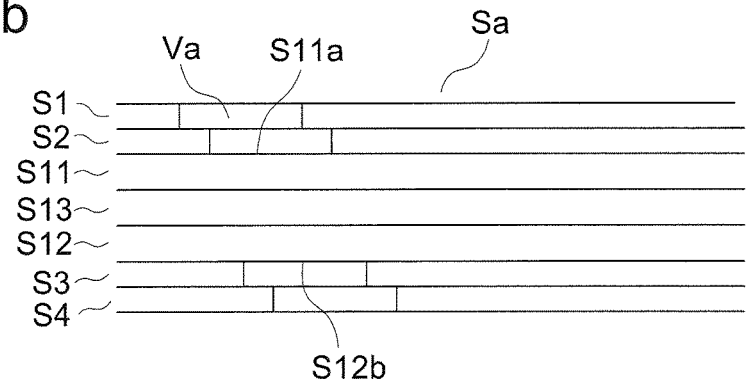

In contrast, in FIG. 20B, of the sheets S11, S12, and S13 with no notches Va formed, no surface to which an adhesive is applied can be formed in the sheet S13 sandwiched between the sheets S11 and S12, whereby adequate tensile strength cannot be ensured for the sheet S13.

In this manner, when at least 3 pages of sheets S with no notches Va formed are continued, the tensile strength of the sheet S sandwiched between the sheets S with no notches Va formed is difficult to ensure.

When at least 3 pages of sheets S with no notches Va formed are continuously selected, the post-processing control section 200 stops the operation, prompting then the operator to make corrections via transmission by warning or display.

Further, in view of tensile strength, even in cases in which a sheet (such as plain paper) other than a specific sheet needs not to be formed with notches and then no notch Va formation is set, when the specific sheet is selected, notches Va are preferably formed in at least a predetermined number of pages of plain paper before and after the specific sheet. Via formation of notches Va in such a predetermined number of pages of plain paper, the tensile strength of the specific sheet can be increased. The predetermined number of pages is selected so that a groove formed by notches Va serves as a space which an adhesive coated on the rear portion of a sheet bundle Sa can adequately enter. The predetermined number of pages is appropriately selected based on bookbinding test production and conventional bookbinding information from the viewpoint of sheet thickness, notch Va dimension, and adhesive mobility. Thereby, the tensile strength of the specific sheet can be increased, and also traces of the adhesive on the rear portion when a booklet is produced can be reduced. Further, the amount of the used adhesive can be reduced.

<Reversing Section 30>

A sheet S having been subjected to notch processing in the notch forming section 300 is stored in a predetermined position of the reversing section 30 by being nipped by conveyance rollers 32, 33, and 34. The reversing section 30 incorporates a sheet placing platform 35 arranged in an inclined manner, a member 36 for sheet rear end positioning which is swingingly rotatable, an adjusting member 37 to allow the sheet S to conform to the sheet width direction, and conveyance rollers 38.

<Sheet Bundle Storing Section 40>

Figure 4:
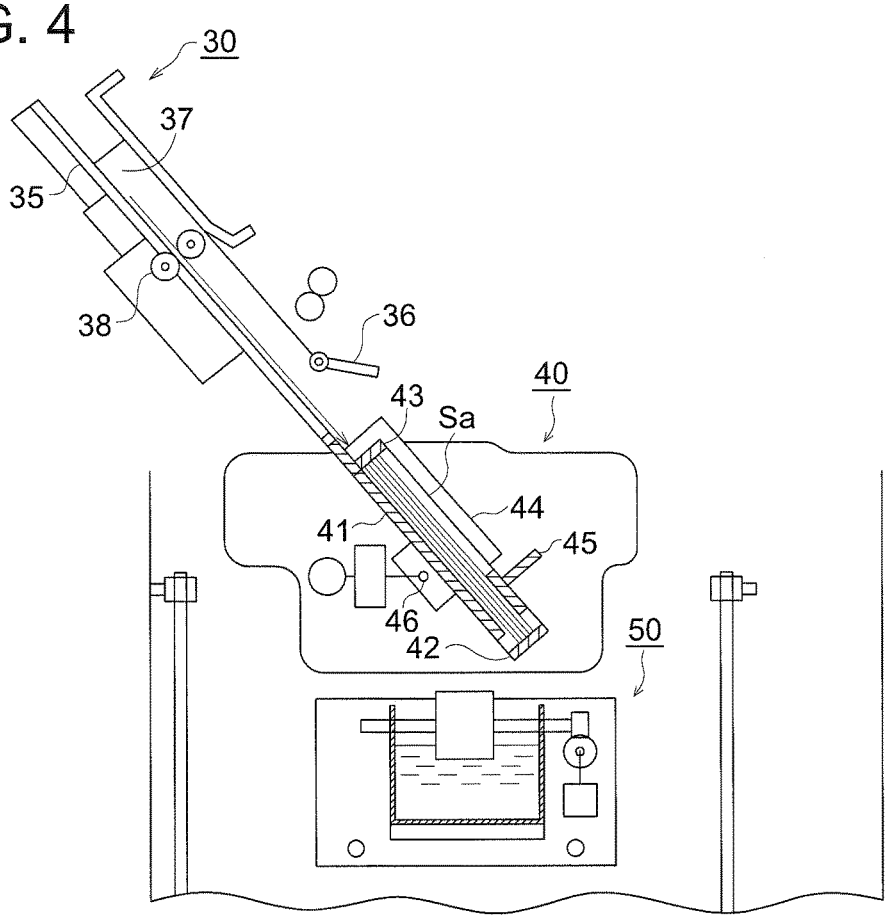
FIG. 4 is a cross-sectional view showing a state where the sheet stacking section of a sheet bundle storing section is placed in an inclined state.

FIG. 4 is a cross-sectional view of a state where the sheet stacking section of the sheet bundle storing section 40 is placed in an inclined state.

The sheet bundle storing section 40 incorporates a supporting member 41, a receiving plate 42, a laterally adjusting member 44, and a pressing member 45.

A sheet S having been placed on the sheet placing platform 35 of the reversing section 30 is nipped by the conveyance rollers 38 and discharged from an opening opened via swinging movement of the positioning member 36 to carry out positioning of the sheet rear end portion, followed by being conveyed obliquely downward. The sheet S is successively stored in the sheet bundle storing section 40 to be stacked.

The sheet bundle storing section 40 incorporates the supporting member 41 having an inclined stacking plane and the swingingly rotatable receiving plate 42. The sheet S having descended from the reversing section 30 slides down on the stacking plane of the inclined supporting member 41 and stops when the front end portion of the sheet S comes into contact with the receiving plate 42. And, the sheet S is supported in an inclined state.

A longitudinally adjusting member 43 presses the rear end portion of the sheet S to allow the front end portion of the sheet S to come into contact with the receiving plate 42, corresponding to the size of the sheet S placed on the stacking plane of the supporting member 41, whereby longitudinal adjustment to adjust the front end portion of each sheet S is carried out.

The sheets S successively discharged from the image forming apparatus A are conveyed via switching back in the reversing section 30 and stacked in the sheet bundle storing section 40, followed by longitudinal adjustment and lateral adjustment to be described later to form a sheet bundle Sa containing a plural number of the sheet S.

The size of the sheet S and the number of sheets forming a sheet bundle Sa, which are setting conditions, are set in the operation section 9 of the image forming apparatus A shown in FIG. 1. Alternatively, such setting is carried out by an external device such as a personal computer connected to the image forming apparatus A.

When the on-line system automatically carrying out operations from image formation to bookbinding processing is activated, the laterally adjusting member 44 presses the side edge of the sheet S conveyed from the reversing section 30 and stored in the sheet bundle storing section 40 for lateral adjustment of the sheet width direction.

When the off-line system is activated to separately carry out bookbinding processing, energization of the laterally adjusting member 44 is stopped, whereby the width direction of a sheet bundle stored from the outside in the sheet bundle storing section 40 is adjusted via manual operations of the laterally adjusting member 44.

The pressing member 45 presses the thickness direction of the sheet bundle Sa stacked in the sheet bundle storing section 40 for nipping. When the sheets S of a set number of sheets are stored in the sheet bundle storing section 40, the pressing member 45 is operated by an unshown drive section, whereby the sheet bundle Sa is nip-supported by a nipping section having the supporting member 41 and the pressing member 45.

Figure 5:
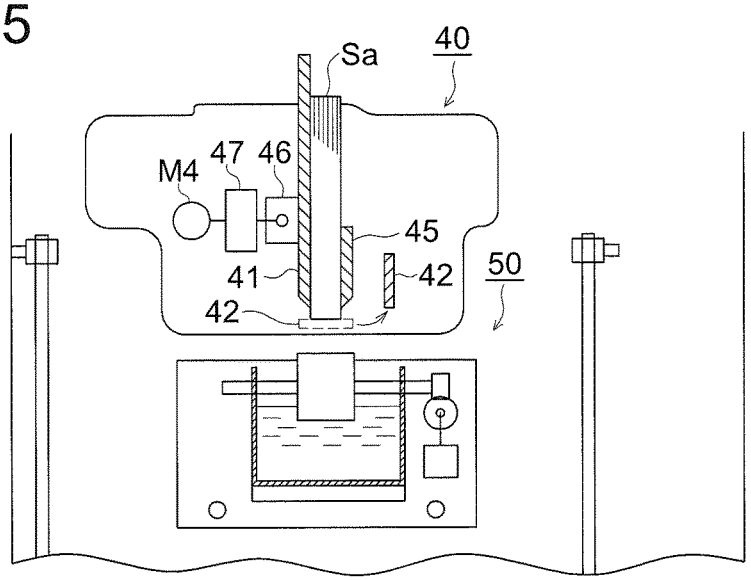
FIG. 5 is a cross-sectional view showing a state where the sheet stacking section of a sheet bundle storing section is placed in the upright state.

FIG. 5 is a cross-sectional view showing a state where the sheet stacking section of the sheet bundle storing section 40 is placed in the upright state.

The supporting member 41 and the pressing member 45 supporting the sheet bundle Sa are rotated around a shaft 46 of the sheet bundle storing section 40 by a motor M4 and a drive section 47, whereby the sheet bundle Sa is allowed to be in the upright state from an inclined state. In this state, the coating section 50 is withdrawn downward and the bottom surface of the sheet bundle Sa is separated from the coating roller 51 of the coating section 50.

Further, in the state where the sheet bundle Sa is supported by the supporting member 41 and the pressing member 45, the receiving plate 42 is withdrawn by being rotated by an unshown drive section from the dashed line position to the solid line position shown.

<Coating Section 50>

Figure 6:
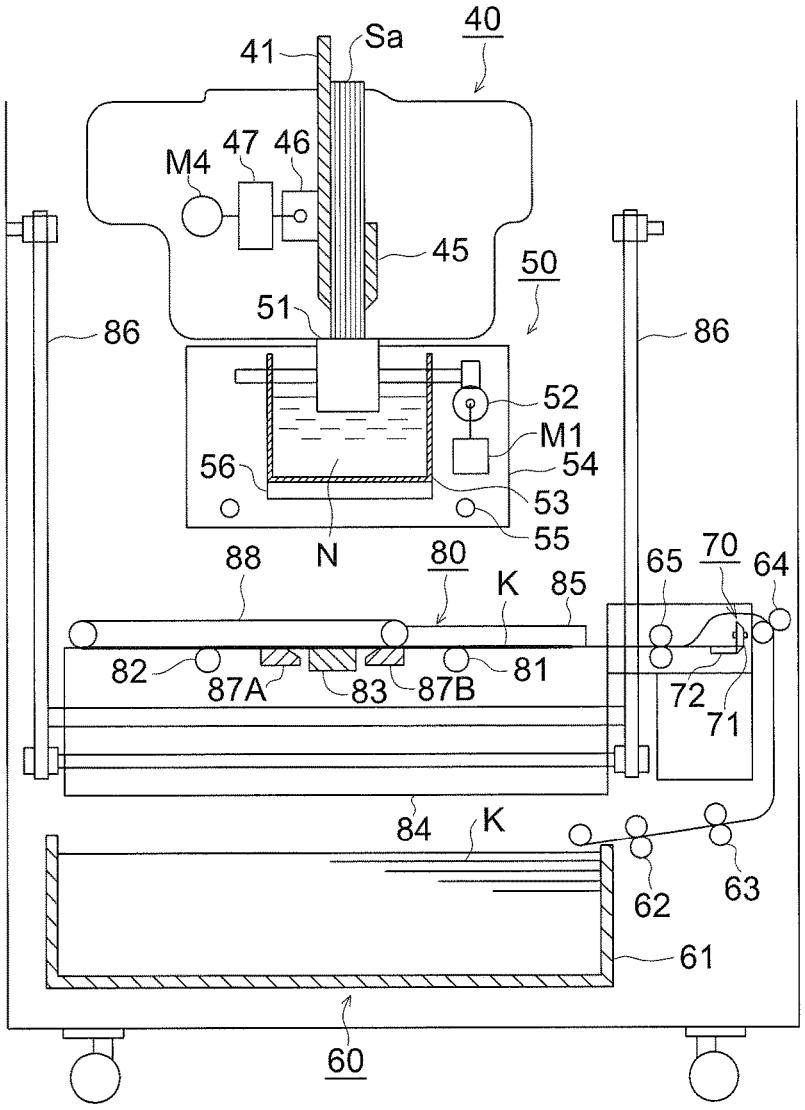
FIG. 6 is a cross-sectional view of a sheet bundle storing section, a coating section, a coversheet feed section, a cutting section, and a booklet forming section.

FIG. 6 is a cross-sectional view of the sheet bundle storing section 40, the coating section 50, the coversheet feed section 60, the cutting section 70, and the booklet forming section 80.

The coating section 50 incorporates a coating roller 51, a drive section 52 to rotationally drive the coating section 51, a container 53 to store an adhesive N such as glue, a moving body 54 able to move, while supporting the container 53, from the initial position of the rear side of the bookbinding apparatus B to the adhesive coating position on the front side, a moving section 55 to reciprocate the moving body 54, and a heating section 56 to heat the adhesive N stored in the container 53.

<Adhesive Coating to a Sheet Bundle>

The moving body 54 of the coating section 50 is moved by the drive section 47 in the direction parallel to the bottom face longitudinal direction of the sheet bundle Sa supported in the upright state by the nipping section having the supporting member 41 and the pressing member 45.

The moving body 54 starts to move from the initial position on the rear side of the bookbinding apparatus B and moves along the moving section 55. The moving body 54 stops at a predetermined position on the front side of the bookbinding apparatus B and then returns to the initial position via reverse drive.

Figure 7:
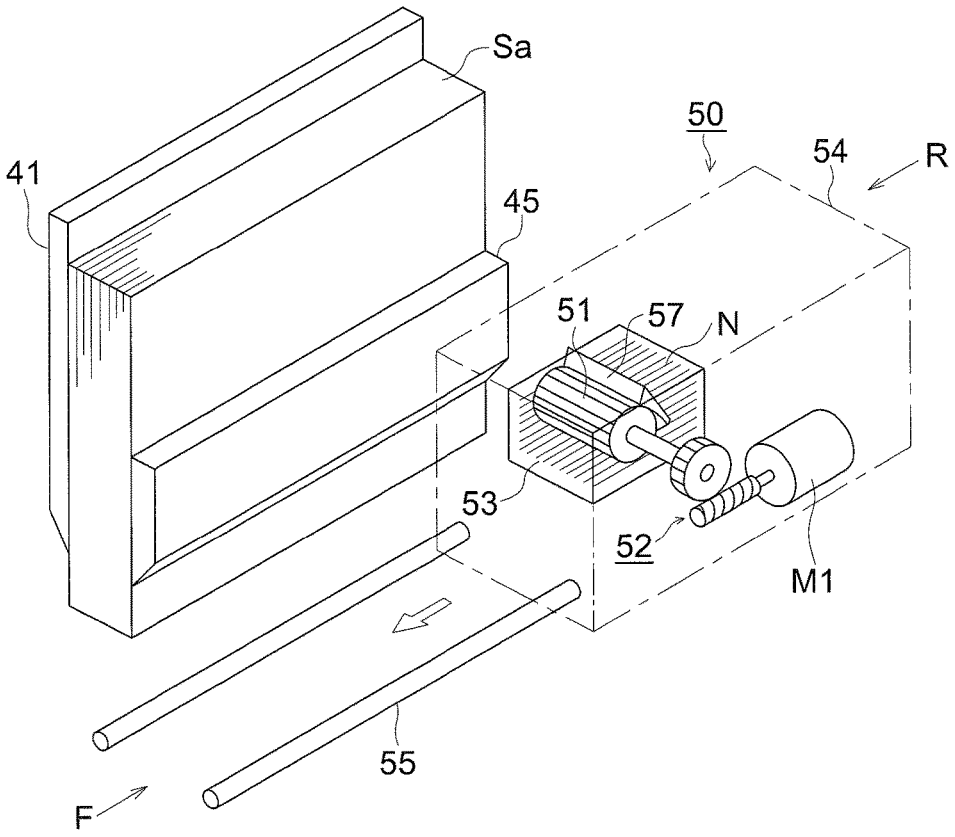
FIG. 7 is an oblique perspective view of a coating section and a nipping section.
Figure 8A:
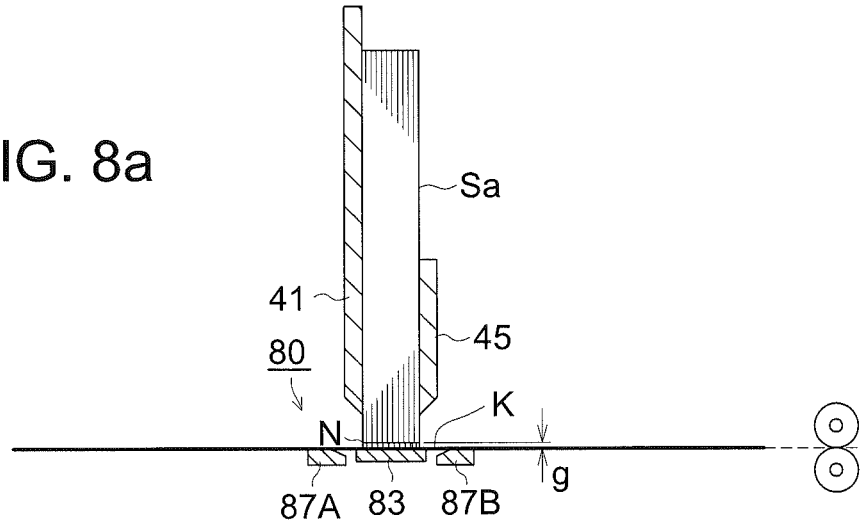
FIG. 8*a* is a cross-sectional view of a booklet forming section and a sheet bundle showing a coversheet folding step.
Figure 8B:
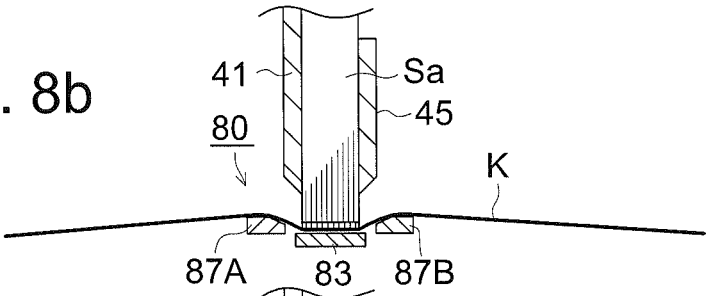
FIG. 8*b* is a cross-sectional view of a booklet forming section and a sheet bundle showing a coversheet folding step.
Figure 8C:
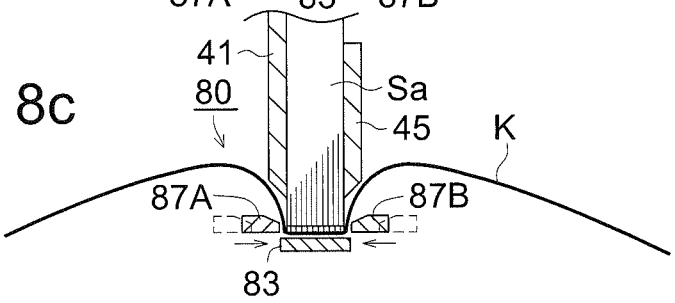
FIG. 8*c* is a cross-sectional view of a booklet forming section and a sheet bundle showing a coversheet folding step.
Figure 8D:
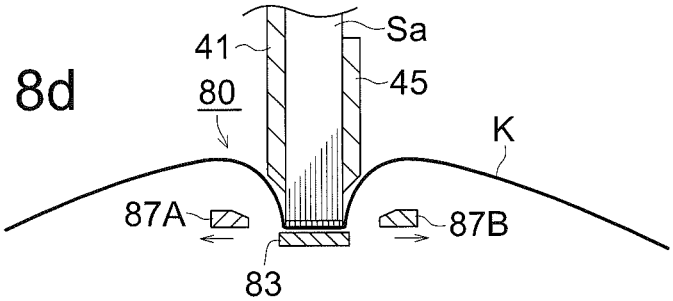
FIG. 8*d* is a cross-sectional view of a booklet forming section and a sheet bundle showing a coversheet folding step.

FIG. 7 is an oblique perspective view of the coating section 50 and the nipping section.

The coating roller 51 immersed in the adhesive container 53 storing an adhesive N is rotated by the motor M1 and the drive section 52. Via returning movement or reciprocation of the moving body 54, the adhesive coating roller 51 coats the adhesive N toward the front side F from the rear side R of the bottom face longitudinal direction of the sheet bundle Sa supported in the upright state.

<Sheet Feed Section 60>

As shown in FIG. 6, a coversheet K being a coversheet stored in the coversheet stacking section 61 of the coversheet feed section 60 is separated and fed from the paper feed section 62, followed by being conveyed to the booklet forming section 80 by being nipped by conveyance rollers 63, 64, and 65.

<Cutting Section 70>

In the shown upper portion of the coversheet feed section 60, the cutting section 70 integrally constituted on the shown right side of the booklet forming section 80 to be described later cuts off the conveyance direction length of the cover sheet K using a rotary cutter having a rotary blade 71 and a fixed blade 72 at a predetermined length.

This predetermined length is a length obtained by adding the length of the rear portion of the sheet bundle Sa to the length covering 2 sheets in the advancing direction of the sheets S. For example, in cases in which case bookbinding processing is carried out in such a manner that a coversheet K is allowed to adhere to the rear portion of a book bundle Sa containing sheets S of A4 size, when the maximum number of sheets of the book bundle Sa is 300 and the thickness thereof is about 30 mm, the predetermined length is set to be 450 mm in which a thickness of about 30 mm of the sheet bundle Sa is added to twice of a short side thickness of 210 mm of an A4-size sheet, whereby the end portion of the cover sheet K is cut off. With regard to the total length of the coversheet K prior to cutting off, a wide size of at least 450 mm is employed.

Also when a booklet Sb is produced via case bookbinding processing of sheets S having an A4 size, a B5 size, or an 8.5×11 inch (1 inch is 25, 4 mm) size, such a predetermined length is set, based on the short side length of a sheet and the thickness of a sheet bundle.

In the operation section 9 of the image forming apparatus A or an external device, sheet size, the number of sheets, and sheet thickness are selectively set or detected, whereby the control section sets the predetermined cutting length of a coversheet K. The length of the coversheet K prior to cutting off is previously determined based on the maximum number of sheets, and the coversheet K is stored in the coversheet stacking section 61 of the coversheet feed section 60.

<Booklet Forming Section 80>

The booklet forming section 80 incorporates conveyance rollers 81 and 82 to receive and convey a coversheet K fed from the coversheet feed section 60 and to stop the coversheet K at a predetermined position, a pressing member 83 to press the coversheet K to be brought into contact with the adhesive coated surface of a sheet bundle Sa, a moving case 84 to support the conveyance rollers 81 and 82 and the pressing member 83, an adjusting section 85, and an elevating section 86 to allow the moving case 84 to move up and down vertically.

The booklet forming section 80 and the booklet discharging belt 88 are integrally moved up and down by the elevating section 86.

When the booklet forming section 80 is stopped at the descended position to introduce a coversheet K, the adjusting section 85 moves from the initial position based on the size of the coversheet K and carries out width adjustment by pressing both width direction sides of the coversheet K prior to cutting processing. The coversheet K having been subjected to winding adjustment via the width adjustment is switched back in the reverse direction to the introduction direction, followed by being conveyed to the cutting section 70 to be cut off at a predetermined position.

Further, before the booklet forming section 80 allows the coversheet K after cutting off to bond to the rear portion of the sheet bundle Sa via adhesion at the descended position, the adjusting section 85 moves again from the initial position and presses both of the width direction sides of the coversheet K for width adjustment to stop the coversheet K at a predetermined position. Thereafter, the adjusting section 85 returns to the initial position so as not to impair adhesion of the coversheet K to the sheet bundle Sa, followed by ascending of the booklet forming section 80. During ascending, the coversheet K is held at a predetermined position.

Therefore, the adjusting section 85 placed in the booklet forming section 80, which is movable up and down, carries out positioning of the coversheet width direction before and after cutting off of the coversheet K using the cutting section 70, whereby enhancement of coversheet cutting accuracy, enhancement of the positioning accuracy between the sheet bundle Sa and the coversheet k, and simplification of the structure are realized.

The elevating section 86 moves the moving case 85 to an upper position via rotation of the right and left belts. At this ascended position, the central portion of the coversheet K placed on the pressing member 83 is pressed into contact with the adhesive N-coated surface of the sheet bundle Sa for adhesion. Via the above pressing, the coated adhesive N partially wraps around the side edges of the front and rear surfaces of the sheet bundle Sa. After coating processing of the adhesive to the sheet bundle Sa, the coating section 50 is moved backward for withdrawal.

<Coversheet Folding Processing>

In the upper portion of the booklet forming section 80, a coversheet folding section is provided. The coversheet folding section incorporates a pair of molded members 87A and 87B which are bilaterally symmetric. The molded members 87A and 87B can be brought into contact with and separated from the thickness direction of the sheet bundle Sa. The molded members 87A and 87B folds the coversheet K along the side edges of the adhesive coated surface of the sheet bundle Sa, followed by nipping via overlapping of the front coversheet and the rear coversheet on the front and rear surfaces of the sheet bundle Sa.

After the folding step of the coversheet K, via descending drive of the elevating section 86, the booklet forming section 80 is descended by a predetermined distance and withdrawn for stopping. Thereafter, nipping by the nipping section is released and thereby the booklet Sb is dropped. Then, the rear portion of the bottom side of the booklet Sb is brought into contact with the top surface of the booklet discharging belt 88 and placed thereon for discharging.

FIG. 8 is a cross-sectional view of the booklet forming section 80 and a sheet bundle Sa showing the folding step of a coversheet K. FIG. 8A and FIG. 8B each show the initiation of coversheet folding and the mid-period of coversheet folding. FIG. 8C and FIG. 8D each show the termination of coversheet folding and the press termination for coversheet folding.

Figure 9A:
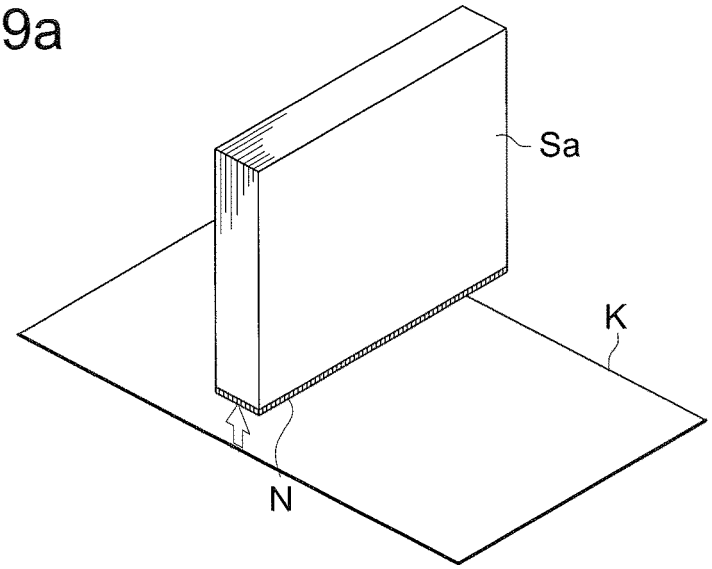
FIG. 9*a* is an oblique perspective view showing a production process of a booklet using a sheet bundle and a coversheet.
Figure 9B:
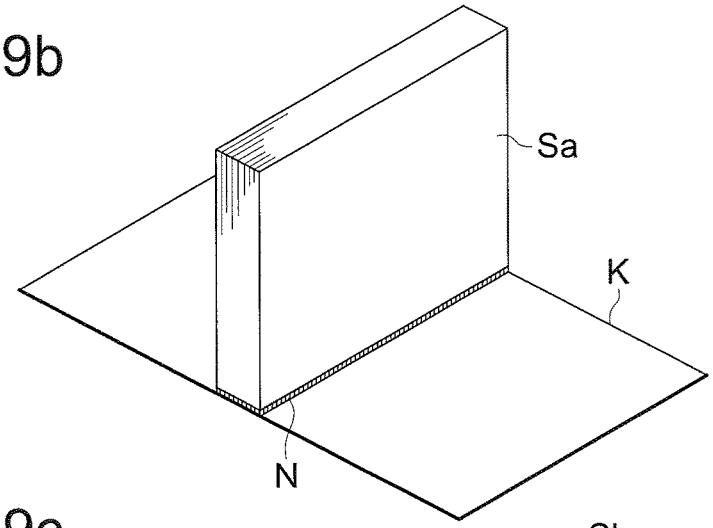
FIG. 9*b* is an oblique perspective view showing a production process of a booklet using a sheet bundle and a coversheet.
Figure 9C:
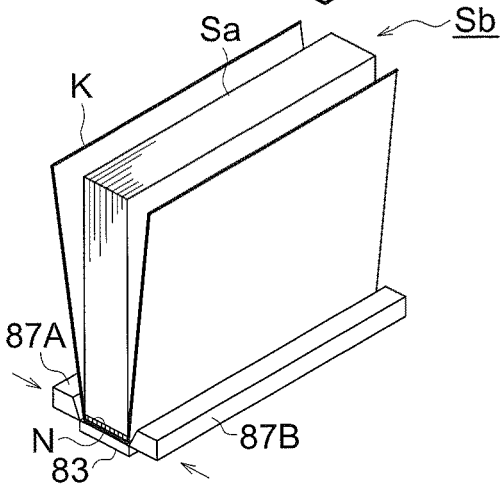
FIG. 9*c* is an oblique perspective view showing a production process of a booklet using a sheet bundle and a coversheet.

FIG. 9 is an oblique perspective view showing a production process of a booklet Sb using a sheet bundle Sa and a coversheet K. FIG. 9A and FIG. 9B each are an oblique perspective view of the coversheet K and the sheet bundle Sa prior to coversheet bonding processing, and an oblique perspective view of the sheet bundle Sa bonded with the coversheet K. FIG. 9C is an oblique perspective view of the booklet Sb produced by case-folding the coversheet K for the sheet bundle Sa.

When the central portion of the coversheet K placed on the pressing member 83 is pressed into contact with the adhesive N-coated surface of the sheet bundle Sa for adhesion, the adhesive N is pressed into the sheet bundle Sa side using the coversheet K to ensure penetration of the adhesive N into the notches Va.

The coversheet K is allowed to adhere to the sheet bundle Sa having been coated with the adhesive N, and thereafter in the ascended state of the booklet forming section 80 shown in FIG. 8, the molded members 87A and 87B are driven by an unshown drive section. The coversheet K is nipped by the molded members 87A and 87B and deformed at the side edges of the adhesive N-coated surface of the sheet bundle Sa (refer to FIG. 8B).

Thereafter, the molded members 87A and 87B horizontally move toward the adhesive N-coated surface side of the sheet bundle Sa. The coversheet K is nip-pressed to both sides of the sheet bundle Sa for a predetermined period of time for cosmetic shaping to form a booklet Sb.

As shown in FIG. 1, the booklet Sb is dropped via nip releasing by releasing the pressing member 45 and placed on the top surface of the discharging belt 88, followed by being discharged toward the booklet discharging outlet 89 and finally discharged in the booklet storing apparatus C outside the apparatus.

The booklet Sb having been discharged is placed on the conveyance belt 91, which is movable up and down, in the booklet storing apparatus C and successively discharged via rotation of the conveyance belt 91 to be stacked and stored on the paper discharging platform 92.

What is claimed is:

1. A bookbinding apparatus structured to produce a booklet from a sheet bundle comprising a plurality of sheets by coating adhesive on a spine portion of the sheet bundle and adhering a coversheet to the spine portion of the sheet bundle, the bookbinding apparatus comprising:

a notch forming section structured to form notches in an edge portion of a sheet, wherein the edge portion having the notches corresponds to the spine portion of the sheet bundle;

a communication section configured to receive notch formation information, the notch formation information indicating whether notches are to be formed in a given sheet of the plurality of sheets;

a control section configured to control the notch forming section such that:

when the notch formation information indicates that notches are to be formed in the given sheet, the notch forming section forms notches in the given sheet; and when the notch formation information indicates that notches are not to be formed in the given sheet, the notch forming section does not form notches in the given sheet; and a position moving section to move a relative position of sheets forming the sheet bundle and the notch forming section in a sheet width direction at right angles to a sheet conveyance direction and, wherein the control section is configured to control a position of the notches so as to change per sheet or per a plurality of sheets with respect to the sheets forming the sheet bundle so as to increase an adhesive force; and wherein the control section is configured to control the position moving section so that the notches partially overlap in adjacent sheets or in adjacent plurality of sheets.

2. The bookbinding apparatus of claim 1, further comprising:

a position moving section to move a relative position of sheets forming the sheet bundle and the notch forming section in a sheet width direction at right angles to a sheet conveyance direction and, wherein the control section controls the position of the notches so as to change per sheet or per a plurality of sheets with respect to the sheets forming the sheet bundle.

3. The bookbinding apparatus of claim 1, wherein the information received by the receiving section includes information regarding pages in which the notches are not formed.

4. The bookbinding apparatus of claim 1, wherein the information received by the receiving section includes information regarding a paper type.

5. The bookbinding apparatus of claim 1, wherein the control section controls the notch forming section so as not to form the notches in coated paper.

6. The book binding apparatus of claim 1, wherein the control section controls the notch forming section so as not to form the notches in a sheet processed by Z-folding.

7. The bookbinding apparatus of claim 1, wherein the control section controls the notch forming section so as not to successively form 3 sheets or more without the notches formed therein.

8. The bookbinding apparatus of claim 1, wherein the control section controls the notch forming section so as to form the notches in sheets of at least a predetermined number of pages conveyed before and after the sheets without the notches formed therein.

9. An image forming system having an image forming apparatus to form an image on a sheet and a bookbinding apparatus of claim 1, which receives a sheet on which an image is formed by the image forming apparatus to produce a booklet.

10. A bookbinding apparatus structured to produce a booklet from a sheet bundle comprising a plurality of sheets by coating adhesive on a spine portion of the sheet bundle and adhering a coversheet to the spine portion of the sheet bundle, the bookbinding apparatus comprising:

a notch forming section structured to form notches in an edge portion of a sheet, wherein the edge portion having the notches corresponds to the spine portion of the sheet bundle;

a communication section configured to receive sheet type information indicating a sheet type of a given sheet; and a control section configured to control the notch formation section such that:

when the sheet type of the given sheet is a first sheet type, the notch forming section forms notches in the given sheet; and when the sheet type of the given sheet is a second sheet type, the notch forming section does not form notches in the given sheet; and a position moving section to move a relative position of sheets forming the sheet bundle and the notch forming section in a sheet width direction at right angles to a sheet conveyance direction and, wherein the control section is configured to control the position of the notches so as to change per sheet or per a plurality of sheets with respect to the sheets forming the sheet bundle so as to increase an adhesive force; and wherein the control section is configured to control the position moving section so that the notches partially overlap in adjacent sheets or in adjacent plurality of sheets.

11. The bookbinding apparatus of claim 10, further comprising:

a position moving section to move a relative position of sheets forming the sheet bundle and the notch forming section in a sheet width direction at right angles to a sheet conveyance direction and, wherein the control section controls the position of the notches so as to change per sheet or per a plurality of sheets with respect to the sheets forming the sheet bundle.

12. The bookbinding apparatus of claim 10, wherein the control section determines pages in which the notches are not formed based on the received information regarding the sheet type.

13. The bookbinding apparatus of claim 10, wherein when a plurality of paper types are used for the sheets, the control section determines paper types in which the notches are not formed.

14. The bookbinding apparatus of claim 10, wherein the control section controls the notch forming section so as not to form the notches in coated paper.

15. The bookbinding apparatus of claim 10, wherein the control section controls the notch forming section so as not to successively form 3 sheets or more without the notches formed therein.

16. The bookbinding apparatus of claim 10, wherein the control section controls the notch forming section so as to form the notches in sheets of at least a predetermined number of pages conveyed before and after the sheets without the notches formed therein.

17. An image forming system having an image forming apparatus to form an image on a sheet and a bookbinding apparatus of claim 10, which receives a sheet on which an image is formed by the image forming apparatus to produce a booklet.

18. The bookbinding apparatus of claim 1, wherein the information received by the receiving section includes information regarding a post-processing.

* * * * *